US009878727B2

(12) United States Patent
Gaile

(10) Patent No.: US 9,878,727 B2
(45) Date of Patent: Jan. 30, 2018

(54) SPRING SYSTEM OF A RAIL VEHICLE

(71) Applicant: Liebherr-Aerospace Lindenberg GmbH, Lindenberg (DE)

(72) Inventor: Anton Gaile, Leutkirch (DE)

(73) Assignee: Liebherr-Aerospace Lindenberg GmbH, Lindenberg (DE)

( * ) Notice: Subject to any disclaimer, the term of this patent is extended or adjusted under 35 U.S.C. 154(b) by 51 days.

(21) Appl. No.: 14/971,350

(22) Filed: Dec. 16, 2015

(65) Prior Publication Data

US 2016/0176417 A1 Jun. 23, 2016

(30) Foreign Application Priority Data

| | | |
|---|---|---|
| Dec. 17, 2014 | (DE) | 10 2014 018 845 |
| Jul. 10, 2015 | (DE) | 10 2015 008 955 |
| Dec. 9, 2015 | (DE) | 10 2015 015 929 |
| Dec. 11, 2015 | (DE) | 10 2015 016 024 |

(51) Int. Cl.
*B61F 5/10* (2006.01)
*B61F 5/06* (2006.01)

(52) U.S. Cl.
CPC . *B61F 5/10* (2013.01); *B61F 5/06* (2013.01)

(58) Field of Classification Search
CPC ..... B61F 5/00; B61F 5/04; B61F 5/06; B61F 5/10
USPC ..... 105/199.3
See application file for complete search history.

(56) References Cited

U.S. PATENT DOCUMENTS

| | | | | |
|---|---|---|---|---|
| 2,440,746 A * | 5/1948 | Hereford | B61F 5/22 | 105/199.2 |
| 4,474,267 A * | 10/1984 | Empson | B61F 5/06 | 105/198.1 |
| 5,769,400 A * | 6/1998 | Holzl | B60G 17/0152 | 105/199.2 |
| 6,360,674 B1 * | 3/2002 | Schuller | B61F 5/14 | 105/199.3 |

(Continued)

FOREIGN PATENT DOCUMENTS

| | | |
|---|---|---|
| DE | 103 15 000 A1 | 11/2003 |
| DE | 10 2006 027 388 A1 | 1/2007 |
| DE | 10 2006 027 288 A1 | 12/2007 |

OTHER PUBLICATIONS

German Search Report issued in counterpart German Application No. 10 2015 008 955.2 dated Sep. 3, 2015, with partial English translation (twelve (12) pages).

*Primary Examiner* — Jason C Smith
(74) *Attorney, Agent, or Firm* — Crowell & Moring LLP

(57) ABSTRACT

A rail vehicle spring system has a spring strut, arranged between a bogie and carriage body of the rail vehicle, and includes a cylinder and a piston in the cylinder. Piston spaces are defined below and above the piston head. The piston or the cylinder is connectable with the bogie, while the other component is connectable with the carriage body. A spring cushions the body relative to the bogie, and a hydraulic system is connected with at least one of the piston spaces to charge the space with hydraulic medium. The spring surrounds the cylinder and is contracted by the piston when an excess pressure exists in the lower piston space with respect to the upper piston space, and an entraining element is adjoined by the spring. Only when an excess pressure exists in the lower piston space does the piston rod exerts a force on the entraining element.

19 Claims, 6 Drawing Sheets

(56) References Cited

U.S. PATENT DOCUMENTS

| | | | | |
|---|---|---|---|---|
| 7,185,592 | B2 | 3/2007 | Hommen et al. | |
| 7,243,606 | B2 | 7/2007 | Hommen et al. | |
| 7,874,254 | B2 | 1/2011 | Lehmair et al. | |
| 2008/0035012 | A1* | 2/2008 | Monaco | B61F 5/14 105/199.3 |
| 2008/0035013 | A1* | 2/2008 | Johnstone | B61F 5/14 105/199.3 |
| 2008/0173211 | A1* | 7/2008 | Kennedy | B61F 5/142 105/199.3 |
| 2008/0210119 | A1* | 9/2008 | Lehmair | B61D 47/00 105/199.3 |
| 2013/0145956 | A1* | 6/2013 | Sammartino | B61F 5/142 105/199.3 |
| 2013/0327245 | A1* | 12/2013 | Aspengen | B61F 5/142 105/199.3 |
| 2015/0047529 | A1* | 2/2015 | Nishimura | B61F 5/32 105/199.3 |
| 2016/0152249 | A1* | 6/2016 | Vladimirovich | B61F 5/14 105/199.3 |
| 2016/0176417 | A1* | 6/2016 | Gaile | B61F 5/10 105/199.3 |

* cited by examiner

SPRING SYSTEM OF A RAIL VEHICLE

BACKGROUND OF THE INVENTION

The present invention relates to a spring system of a rail vehicle with at least one spring strut for arrangement between bogie and carriage body of the rail vehicle. The spring strut includes at least one cylinder and at least one piston shiftably accommodated in the cylinder, which define piston spaces below and above the piston head. The piston or the cylinder is directly or indirectly connectable or connected with the bogie, and the other one of the components is directly or indirectly connectable or connected with the carriage body, and with at least one spring which is arranged such that the same cushions the carriage body with respect to the bogie.

Such a spring system is known from German document DE 10 2006 027 288 A1. The spring system disclosed there comprises a non-resilient hydraulic system which is connected with the piston space and by means of which the quantity of the hydraulic medium in the piston space is variable for the purpose of adjustment of the spring strut length. Furthermore, there is provided a stop element by means of which the end position of the piston in the cylinder is variable. This stop element is actuated when in a case of fault the piston space or the hydraulic system is pressureless or the pressure falls below a certain value.

In this known spring system a special emergency system is activated upon failure of the hydraulic system, so that no operational constraints must be accepted. The same include for example a reduced speed, a reduced number of passengers as well as putting the rail vehicle out of operation.

Typical spring systems are furthermore known from German document DE 103 15 000 A1 and U.S. Pat. Nos. 7,185,592 B2, 7,243,606 B2 and 7,874,254 B2.

In German document DE 103 15 000 A1 a secondary spring system of a rail vehicle is disclosed, wherein between a bogie and a carriage body a spring stage is arranged. The spring stage includes a passive steel spring and an actuator. When the actuator is released, the steel spring effects that the carriage body is lifted into a driving position. During stoppage in a railway station, the actuator pulls the carriage body in direction of the subframe against the restoring force caused by the steel spring. The actuator can be a hydraulic actuator.

U.S. Pat. No. 7,185,592B2 discloses a development of the system shown in DE 103 15 000 A1. There is presented a special hydraulic system for the actuator, which comprises a hydropneumatic accumulator and depressurizes the actuator when the carriage body is lifted.

U.S. Pat. No. 7,243,606 B2 discloses an alternative solution of a generic system, in which the secondary spring system includes a hydropneumatic spring unit.

U.S. Pat. No. 7,874,254 B2 discloses a further solution of a generic system, in which a special construction of the piston rod is provided.

SUMMARY OF THE INVENTION

It is an object underlying the present invention to provide an improved spring system of the type mentioned.

This object is solved by a spring system with the features claimed.

The terms "at the top" or "above" and "at the bottom" or "below" as used in connection with the piston spaces are not to be understood such that in the installation situation the upper piston space is located vertically above the lower piston space. Rather, the terms "at the top" or "above" and "at the bottom" or "below" merely designate the two opposite sides of the piston head.

The spring system according to the present invention allows a height adaptation of the rail vehicle, in order to keep the height difference between the entry of the rail vehicle and the curbstone at a stop as low as possible independent of the loading. This height adaptation is effected by means of the piston or by means of the change in height of the spring strut correlated with the compression of the spring.

The spring system according to the invention is a "pull down system". This means that at the stop the rail vehicle is pulled down against the spring force, i.e. against the force applied by the spring, by means of a hydraulic system, i.e. by means of the hydraulic medium present in the lower piston space. When no hydraulic medium is present in the lower piston space or there is no excess pressure with respect to the upper piston space, the spring and thus the spring strut as well advances again, wherein the height of the spring strut or the extension path beside the type of the at least one spring chosen depends on the loading of the rail vehicle.

Upon failure of the hydraulic system, the spring system according to the invention experiences no operational constraints for the rail vehicle. Although in the case of fault of the hydraulic system the hydraulic system no longer is available, there are no operational constraints, as the suspension in this case completely is performed by the at least one spring of the spring strut, which also performs a suspension when the hydraulic system does not work.

The spring system according to the invention is characterized in that in a case of fault, i.e. for example upon failure of the hydraulic system, such as upon failure of its pump, the rail vehicle is at nominal operating height and the suspension of the vehicle is fully available.

This preferably is achieved in that the actuating element of the pull down system, i.e. the piston or the piston-cylinder unit, preferably is out of engagement in the case of a system failure of the hydraulic system. In other words, in the condition in which the hydraulic system does not work the piston or its piston rod preferably does not act on the spring, so that the same can move unimpeded.

The at least one spring preferably is a mechanical spring and particularly preferably a coil spring. There can also be provided several springs and in particular coil springs, which e.g. can be arranged concentrically to each other.

According to the invention it is provided that the at least one spring surrounds the at least one cylinder or the piston-cylinder unit (altogether also referred to as pull-down cylinder). The spring also called secondary spring for example can be a rubber or steel spring. Due to the arrangement of the cylinder and the piston it is possible to keep the bogie frame completely free from additional forces.

Moreover, there are not required any additional connecting points at the bogie frame.

In addition, there is preferably provided at least one entraining element to which the at least one spring adjoins in at least one operating condition, wherein the piston and in particular its piston rod only exerts a force on the entraining element, which leads to a compression of the spring, when an excess pressure exists in the lower piston space (22*a*) with respect to the upper piston space (22*b*).

At this point it should be noted that the term "piston" also comprises the piston rod with the piston portion which is in contact with the cylinder wall.

Preferably, the pull-down cylinder on one side only is (directly or indirectly) either firmly connected with the bogie frame or with the carriage body and on the other side only loosely engages an entraining plate or some other entraining element which has the task to compress the spring, when an excess pressure exists in the lower piston space (22*a*) with respect to the upper piston space (22*b*).

Preferably, it is provided that in driving operation, i.e. not in the region of the stop position of the rail vehicle, the pull-down cylinder is extended by the spring to such an extent that the piston rod no longer is connected with the entraining element, and in any case does not exert a force compressing the spring. In driving operation, the piston or the piston rod either cannot be connected with the entraining element at all or only such that on contact with the entraining element the piston is extended further from the cylinder.

This involves the advantage that a comparatively simple cylinder or a comparatively simple pull-down cylinder can be used, which does not require any special bearing elements, such as rubber joint bearings or spherical plain bearings.

To provide for a transverse path or a movement in transverse direction to the spring between the two spring ends, it preferably is provided that the piston rod or the piston, when no excess pressure exists in the lower piston space (22*a*) with respect to the upper piston space (22*b*), has a clearance with respect to the entraining element in transverse direction of the movement of the piston. Thus, the necessary transverse path between the two sides of the at least one spring preferably is realized in that in particular the piston rod is smaller in diameter than the bore in the spring pressure plate or in the entraining element, through which the piston rod or another portion of the piston extends. Due to this comparatively simple measure, the lower spring receptacle can move laterally to the upper spring receptacle, without the pull-down cylinder having to be suspended flexibly.

To be able to permit a transverse clearance and thus also a slight tilting movement between the upper and the lower part of the secondary spring, i.e. the at least one spring of the spring strut, it preferably is provided that the piston rod is designed flexible in at least one portion. This region for example can be located outside the cylinder and thus form the extension of the piston rod. This flexibility for example can be achieved in that the piston rod is tapered or also by an additional element, such as a coupling rod, a chain, a wire rope or the like.

In one aspect of the invention, the piston of the pull-down cylinder only is actively loaded in pulling direction. When removing the control pressure or upon pressure relief of the lower piston space, the pull-down cylinder again is pulled apart by the spring, i.e. the piston is extended over a certain distance. It thereby is sufficient that the pull-down cylinder or the lower piston space only is connected with a single hydraulic line.

When a reduction of the height of the spring strut is required, the lower piston space is charged with hydraulic medium, i.e. pressurized. When this is not the case, such as in driving operation of the rail vehicle, a pressure relief simply is effected via the same hydraulic line, which leads to the fact that the height of the spring strut is determined by the spring and not by the pressure no longer prevailing then in the lower piston space. An active control is not required either for the release operation. It thus is sufficient when the control pressure is relieved towards the tank of the hydraulic system.

It is particularly advantageous that in normal driving operation the pull-down cylinder need not join in the spring movement of the spring, i.e. when the position of the piston in the cylinder remains unchanged in normal driving operation. This is possible because the pull-down cylinder is firmly connected with the spring element on one side only, whereas the other side is loosely connected e.g. with said entraining plate. The wear at the cylinder thereby is greatly reduced.

As explained above, a further advantage of the invention consists in that in one aspect of the invention the cylinder or the piston only is extended and not compressed again during relief and during travel. This provides for a simplified actuation which does not require any hydraulic preload or feed, as during travel oil or some other hydraulic medium never has to be fed into the piston spaces.

In a further aspect of the invention at least one piston-cylinder unit is provided for the purpose of wheel wear compensation, which is arranged in series with the pull-down cylinder. Along the length of this further piston-cylinder unit the length of the complete secondary spring arrangement can be varied.

It furthermore is advantageous when the hydraulic system includes two 2/2-way valves or one 3/2-way valve per lower piston space. Thus, an actuation of each individual spring strut out of the hydraulic system is possible by means of two 2/2-way valves each or by means of one 3/2-way valve. This results from the fact that the pull-down cylinder only requires a single actuation signal and need not be relieved actively. It only requires little or no hydraulic preload, and in driving operation no oil must be supplied into the cylinder.

In principle, it is conceivable to of course also use a proportional valve for the actuation of the spring struts. This has the advantage that a more gentle control can be achieved and a bump on stopping is prevented.

In principle, it is conceivable that the hydraulic system includes one actuation strand each, i.e. one line/valve system per lower piston space or per bogie axle or per carriage body. Thus, a spring-strut-selective actuation or also an axle-specific or carriage-body-specific actuation is possible.

In principle, only one actuation branch per carriage body also is conceivable, but the accuracy with respect to the adjustment of the vehicle height at the stop is dependent on the number of the individually controllable or adjustable elements. This means that with a spring-strut-selective actuation the vehicle or entry height can be controlled more precisely than with the use of an axle-selective or carriage-body-selective actuation.

In a further aspect of the invention it is provided that at least one redundant release path is provided for the hydraulic system, without additional valves being required. It is conceivable that for the lifting side, i.e. for the pressurization of the piston space and for the lowering valves, i.e. for the relief of the lower piston space, there are used valves which are normally open. This has the advantage that in the case of a complete shut-down of the system at least two hydraulic paths in any case exist in a currentless condition of the hydraulic system, via which the piston space of the pull-down cylinder can be relieved. For this variant at least two actuation paths are required.

This principle is possible in every conceivable variant, such as for example in the case of the axle-selective actuation, but also in any other of the above-mentioned system variants, and is comprised by the invention.

Preferably, it is provided that the redundancy is achieved in that at least two valves (preferably two 2/2-way valves) are provided, via which a pressure relief can be effected, and that during the malfunction of one valve the pressure relief can be effected via the other valve.

In an alternative aspect of the invention it can be provided that from the hydraulic system at least one hydraulic line each extends to the lower piston space and to the upper piston space, wherein the hydraulic line of the upper piston space preferably branches off from the hydraulic line of the lower piston space. The lower piston space thus preferably is not depressurized for lifting the carriage, but the pressure in the upper piston space rather is increased. This of course likewise applies for each spring strut of the system.

It can be provided for example that in the branched hydraulic line of the upper piston space a preferably normally open 2/2-way valve is arranged. For lowering the spring strut to platform level, the 2/2-way valve can be energized (closed) and the pump of the hydraulic system can be activated, in order to charge the lower piston space with excess pressure and retract the spring. When the desired level is reached, the pump can be switched off. For lifting the vehicle, the 2/2-way valve can be switched currentless (opened) and the pump can again be switched on. Hydraulic fluid then flows from the lower into the upper chamber and in addition from the pump into the upper chamber. The spring relaxes until reaching the stop. When the stop is reached, the pump in turn is switched off.

Furthermore, it can be provided that from the hydraulic line of the upper piston space a relief line preferably branches off on the piston side of the 2/2-way valve.

In one embodiment, a pressure limiting valve can be arranged in the relief line, which provides for a discharge of hydraulic fluid from the upper piston space, when an excess pressure of e.g. at least 2 or 3 bar is reached. During the above-described lowering operation of the spring strut, hydraulic fluid then present in the upper piston space, which is expelled due to the pressure increase in the lower piston space, can flow back into the reservoir of the hydraulic system.

Alternatively, a normally open 2/2-way valve can be arranged in the relief line, which provides for an active extension of the cylinder. In the hydraulic line of the upper piston space 22*b* a normally closed 2/2-way valve furthermore can be arranged on the piston-space side of the branching point, which can serve as fail-safe valve and can effect that the hydraulic pressure in the upper piston space also is maintained in the currentless condition. Moreover, for pressure compensation a hydropneumatic accumulator in this case can be provided on the piston-space side of the solenoid valve.

In a further aspect of the invention at least one height sensor is provided, which measures the height of the spring strut or a quantity correlated therewith. When using an axle-selective actuation it is sufficient in principle to use one height sensor each per bogie. It is recommendable to arrange the same crosswise, so that track faults can be compensated more easily.

In principle, other aspects also are conceivable, such as for example the one where one height sensor each is used per spring strut or only exactly one height sensor altogether is used for the carriage body.

Furthermore, it preferably is provided that the spring system includes a regulating unit or a control unit for height adjustment, which is connected with the at least one height sensor such that the actual values received by the height sensor are processed to the effect that the hydraulic system correspondingly is actuated or controlled such that a certain value (setpoint) of the height of the spring strut is adjusted.

The present invention furthermore relates to a rail vehicle with at least one spring system according to the invention. The rail vehicle includes at least one bogie and at least one carriage body, between which at least one spring strut of a spring system according to the invention is arranged.

Particular advantages of the invention consist in that in a preferred aspect of the invention the pull-down cylinder is arranged within the spring, i.e. the spring surrounds the pull-down cylinder, that the pull-down cylinder is firmly connected only with one end of the spring, that the cylinder is not moved during travel, but at best only is pulled apart further and further, as well as the hydraulically redundant relief without additional valves.

The present invention furthermore relates to a leveling system, in particular a spring system according to the invention for the height adjustment in particular of a rail vehicle or some other vehicle, wherein the leveling system includes at least one piston-cylinder unit for adjusting the height and at least one hydraulic system which is connected with the piston space of the piston-cylinder unit, wherein the hydraulic system is formed such that the relief of the piston space is effected redundantly.

It is conceivable that to achieve the redundancy at least two valves connected in parallel are present in the hydraulic system, wherein it preferably is provided that these are 2/2-way valves and/or normally open valves.

The leveling system can be formed according to a spring system of the invention, i.e. be formed by the same or have its features.

The present invention relates to a vehicle, in particular a rail vehicle, with at least one spring system according to the invention or with at least one leveling system according to the invention.

BRIEF DESCRIPTION OF THE DRAWINGS

Further details and advantages of the invention will be explained in detail with reference to an exemplary embodiment illustrated in the drawings, in which.

DETAILED DESCRIPTION OF THE INVENTION

Figure 1:
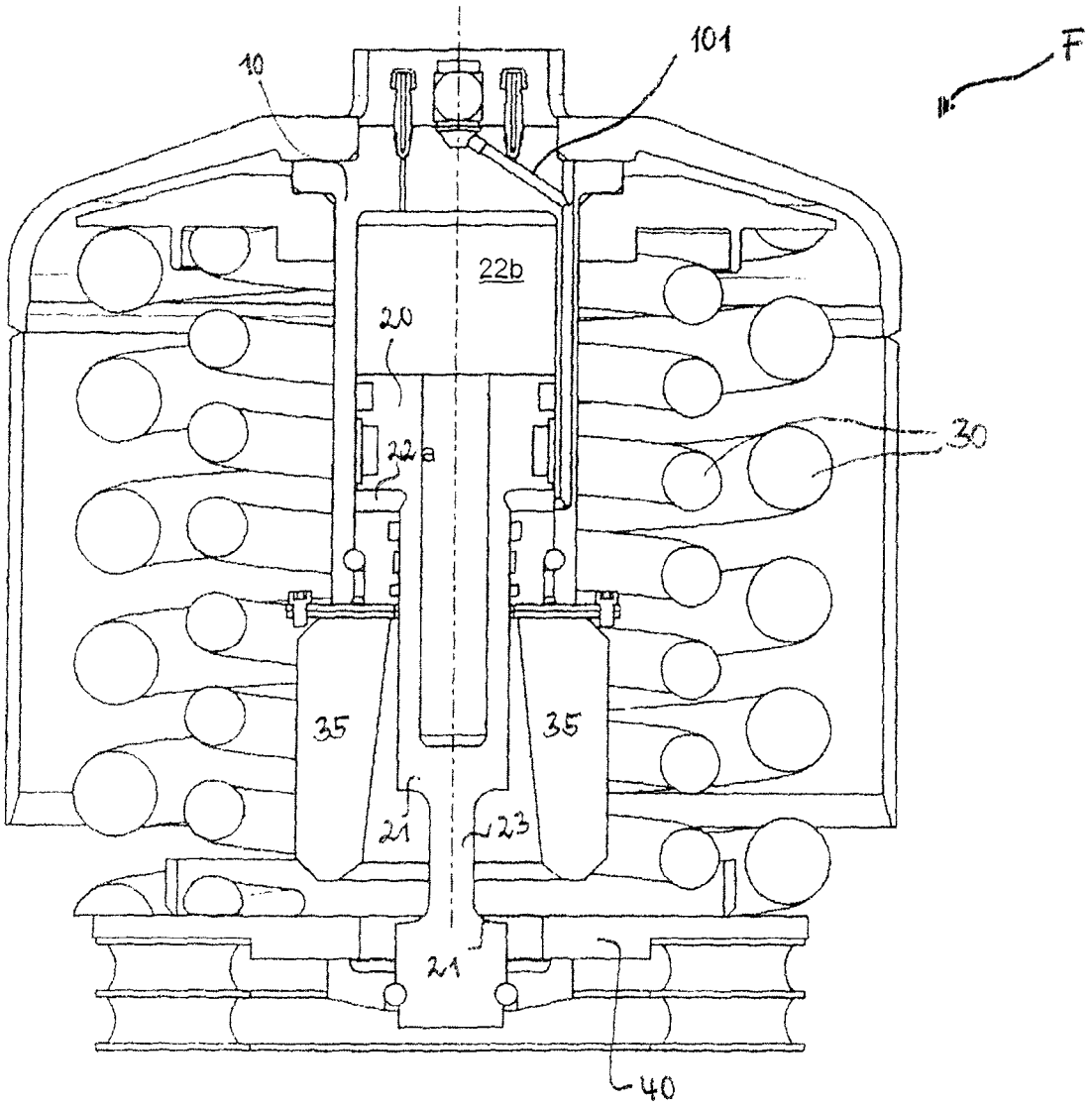
FIG. 1 shows a sectional view through a spring strut according to the invention in the driving position with empty rail vehicle.

With reference numeral F, FIG. 1 shows a spring strut of a spring system according to the invention.

The central part of the spring strut F is formed by the piston-cylinder unit, i.e. the pull-down cylinder comprising the cylinder 10 and the piston 20 movably accommodated therein. The piston 20 consists of a portion which is sealingly arranged with respect to the cylinder and rests against the cylinder inner wall and of a piston rod 21 which adjoins this portion.

As can also be taken from FIG. 1, a hydraulic line 101 is present in the cylinder. This line connects the pump P of the hydraulic system H shown in FIGS. 3 and 4 with the lower piston space 22*a* and the upper piston space 22*b*. The same extends between the piston portion, which sealingly rests against the cylinder 10, and the cylinder bottom shown below. A pressurization of the lower piston space 22*a* therefore leads to the fact that the piston 20 is moved upwards in the cylinder and thus compresses the spring via the lower piston portion, which then is in engagement with the spring pressure plate 40.

The cylinder 10 is surrounded by coil springs 30 arranged concentrically to the same, as can be taken from FIG. 1. In the upper end region, the springs 30 are indirectly, but firmly connected with the cylinder. In the lower region the at least one spring supports on said entraining plate 40, which includes a bore through which the tapered portion 23 of the piston rod 21 extends with a clearance in lateral direction. Furthermore, conical and hollow rubber dampers 35 extend from the cylinder bottom, which bulge on compression of the spring, as is shown in FIG. 2.

Figure 2:
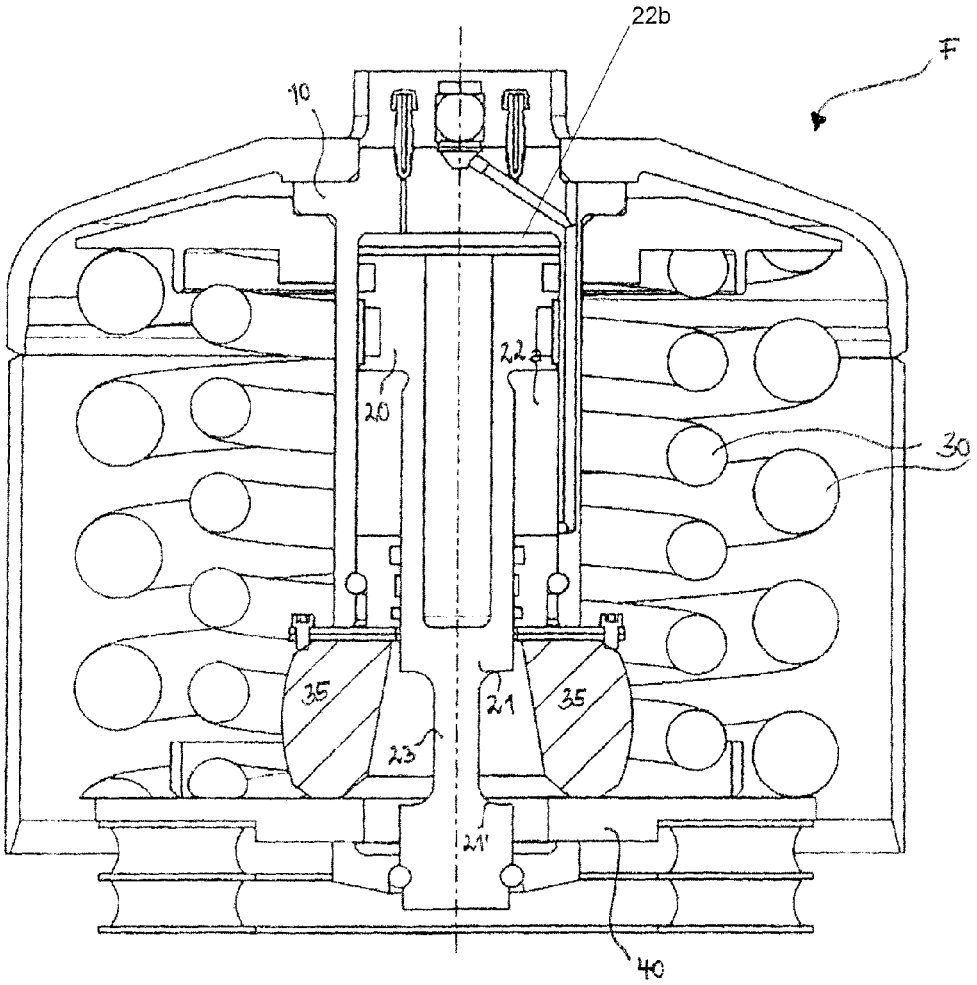
FIG. 2 shows a sectional view through a spring strut according to the invention in the stop position in which the vehicle is lowered.

From FIGS. 1 and 2 it can furthermore be taken that only a single hydraulic line 101 leads into the lower piston space 22*a*, through which the hydraulic medium from the hydraulic system H is introduced into the lower piston space 22*a* and through which the hydraulic medium also is drained again. In this embodiment, the upper piston space 22*b* is not connected to the hydraulic system H.

The spring strut is in the condition shown in FIG. 1, when the rail vehicle is in the driving operation, i.e. need not be lowered. In this case, the suspension exclusively is effected via the spring 30 and possibly supported by the dampers 35 which support on the entraining plate 40 or also on one point of the spring strut. The dampers 35 are optional components.

In driving operation, the suspension thus exclusively is effected mechanically.

The spring strut F is arranged between the bogie and the carriage body of a rail vehicle, wherein the carriage body can be arranged at the top or at the bottom and the bogie on the other side of the spring strut F.

In the driving operation as shown in FIG. 1, the piston 20 either remains unmoved relative to the cylinder 10 or at best is extracted, namely when the piston with its portion 21' strikes against the entraining plate 40 at the bottom. In this case, the piston 20 is moved a bit downwards by the entraining plate 40, i.e. moves downwards proceeding from the cylinder head.

In driving operation, the piston however never is pressed into the cylinder 10, as no corresponding force is present which would effect such inward movement of the piston.

The tapered region 23 of the piston rod 21 allows a slight tilting movement between upper and lower part of the secondary spring 30. Due to the fact that in driving operation the piston is not moved or at best moved in pull-out direction in the cylinder 10, a low-wear operation is possible.

A transverse path between the upper side and the lower side of the spring is realized in that the piston rod 21 in any case in its portion extending through the bore of the entraining plate 40 is smaller than the diameter of the bore, so that a clearance is obtained in lateral direction.

When the rail vehicle is to be lowered, hydraulic medium is introduced into the lower piston space 22*a* via the hydraulic line 101. This leads to the fact that due to the resulting force between the lower side of the piston and the bottom wall of the cylinder the spring is compressed, as is shown in FIG. 2. This compression of the spring at the same time also leads to a compression of the dampers 35. The compression of the spring is effected, as the piston with its portion 21' engages the entraining plate 40 from below and thus compresses the spring 30, which adjoins the entraining plate 40, and also the dampers. In this way, it is possible to lower the rail vehicle in the stationary condition or at the platform to the desired height. The height is adjustable by the volume of the hydraulic medium introduced into the lower piston space 22*a*.

Figure 3:
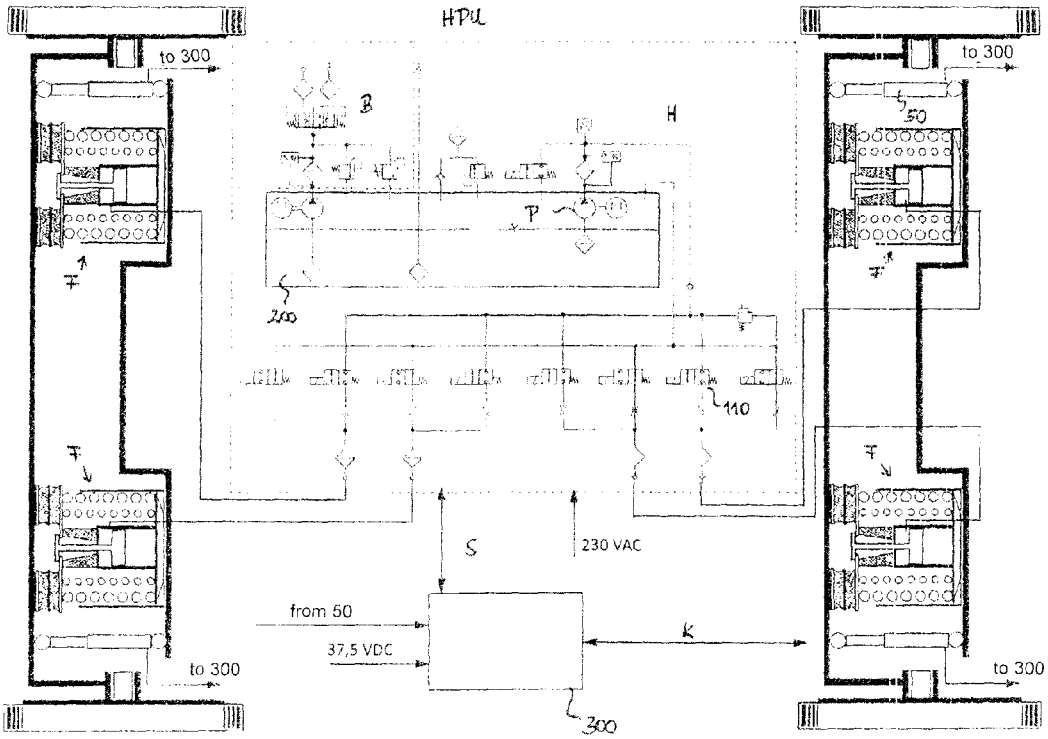
FIG. 3 shows a schematic view of a spring system according to the invention with spring-strut-selective actuation.

FIG. 3 shows a schematic view of a spring system according to the invention. The reference numeral HPU designates the hydraulic power unit which includes the hydraulic system H with the pump P and a drive or motor M for driving the pump, a filter, a freewheel valve, a pressure switch and a pressure relief valve. This component also is referred to as supply module. Furthermore, a brake module B optionally can be provided, which likewise includes a motor, a pump, a filter, a pressure control valve, a pressure relief valve and an isolation valve.

A further component of the HPU is the actuating unit comprising valves and lines for pressurization and relief of the piston spaces of the spring struts F.

Finally, there is provided a control and regulating unit 300 for the pull-down cylinders of the spring struts F, which suitably actuates the valves 110.

Reference numeral 200 designates the tank from which the pump delivers and into which the returning hydraulic medium is introduced.

With reference numeral 50 height sensors are provided, which measure the height of the individual spring struts.

In the exemplary embodiment shown in FIG. 3, one height sensor 50 is provided per spring strut F. Other embodiments also are conceivable in principle, for example that per bogie only one height sensor is provided.

The height sensors 50 supply their signals to the control or regulating unit 300. The same communicates with the rail vehicle via the connection K and sends signals S or a feedback to the HPU.

The illustrated voltage values only are of an exemplary nature.

As explained, the HPU comprises the brake module B, the supply module H and the actuating unit in the form of the valves. The same can consist either of four or of eight 2/2-way valves 110. An actuation by means of two or four 3/2-way valves also is conceivable.

Figure 4:
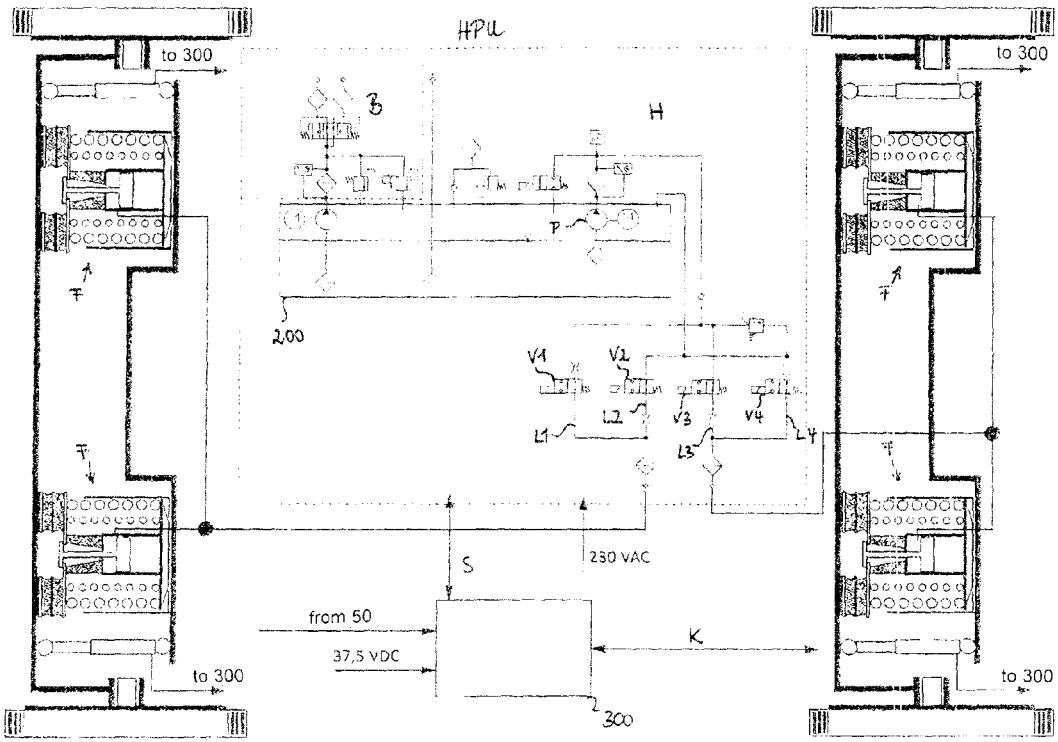
FIG. 4 shows a schematic view of a spring system according to the invention with a control axle by axle and with a hydraulically redundant release path.

In the exemplary embodiment shown in FIG. 4, the individual spring struts are not actuated individually, as is the case in FIG. 3, but a control is effected axle by axle or bogie by bogie.

FIG. 4 shows that a hydraulically redundant release path is provided, which means that the hydraulic medium from the lower piston space 22*a* each flows back to the tank via two paths and thus a reliable relief or lowering of the spring struts is possible.

In FIG. 4 four lines L1-L4 are indicated, wherein the lines L1 and L3 serve for pressurization, i.e. via these lines the hydraulic medium is delivered by the pump P to the respective piston space of the spring struts via the valves V1, V3.

The lines L2 and L4 serve for relief, i.e. via these lines the hydraulic medium is delivered from the respective lower piston space 22*a* of the spring struts to the tank 200. In a case of fault, the valves V1 to V4 preferably are open, i.e. normally open, so that a relief and thus a driving operation is possible.

When a valve, e.g. the valve V4 is blocked, i.e. a relief into the tank 200 is not possible via this valve V4, the relief is effected via the path of valve V3 as well as the valves V1 and V2 actually associated to the other bogie. The hydraulic medium hence does not flow into the tank 200 directly via V4, but through the valve V3, the valve V1 and finally the valve V2 and thus gets into the tank 200. This redundancy during relief ensures that all spring struts can be relieved, when a relief valve does not work correctly or blocks in the closed position.

The valves according to FIGS. 3 and 4 preferably are formed as 2/2-way valves.

In principle it is also possible to use one 3/2-way valve each for two 2/2-way valves, which however involves the disadvantage that the described redundancy is not possible in this way.

The described redundancy of course not only is possible in the actuation bogie by bogie with hydraulic medium, but also in the spring-strut-individual actuation or also in a single actuation per carriage body.

Figure 5:
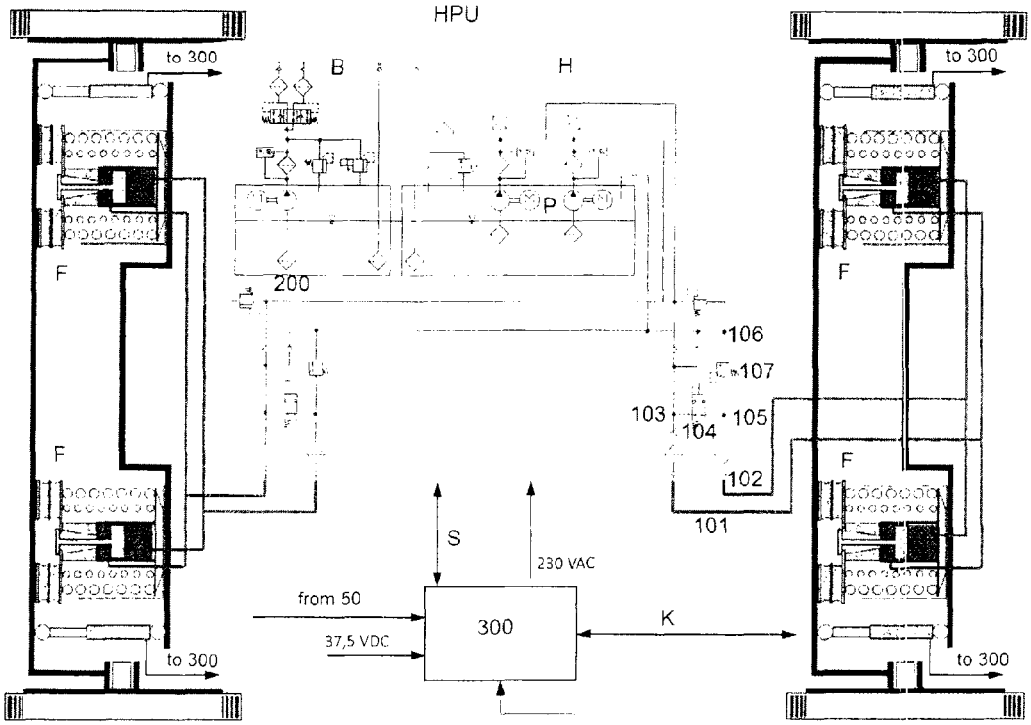
FIG. 5 shows a schematic view of a further embodiment of a spring system according to the invention.

FIG. 5 shows a schematic view of a further embodiment of a spring system according to the invention, wherein this embodiment generally differs from the embodiments shown in the preceding Figures in that the upper piston space 22*b* also is connected with the hydraulic system H and that the hydraulic system is constructed differently. In the following, merely differences to the embodiment according to FIG. 4 will be discussed. Identical parts are provided with identical reference numerals.

In the configuration according to FIG. 5, a hydraulic line 101 extends from the hydraulic system H to the lower piston space 22*a* and a hydraulic line 102 extends to the upper piston space. The hydraulic line 102 branches off from the hydraulic line 101 at the branching point 103. This of course also equally applies for each spring strut F of the system shown. It thus becomes possible that lifting of the carriage can be effected such that the pressure in the upper piston space 22*b* is increased.

In the hydraulic line 102 of the upper piston space 22*b* a normally open 2/2-way valve 104 is arranged. When the spring strut F is to be lowered to platform level, the 2/2-way valve 104 is energized and closed and the pump P of the hydraulic system H is activated. This leads to the fact that the lower piston space 22*a* is charged with excess pressure and the spring strut F is retracted against the restoring force of the mechanical spring 30. When the desired level is reached, the pump P can be switched off. When the spring strut F subsequently again is to be lifted to driving level, the 2/2-way valve 104 is deenergized and opened and the pump P in turn is activated, so that hydraulic fluid flows from the lower into the upper chamber and in addition from the pump into the upper chamber. The spring 30 relaxes until reaching the stop. When the stop is reached, the pump P in turn is switched off. Due to the use of a normally open valve 104 and the possibility of pressure compensation between the two piston spaces 22*a* and 22*b* with open valve 104, there is also taken the safety measure that in the case of a power failure or a similar malfunction the spring strut F is lifted to driving level.

At the branching point 105 a relief line 106 branches off from the hydraulic line 102 of the upper piston space 22*b*, in which a pressure limiting valve 107 is arranged. This valve 107 provides for a discharge of hydraulic fluid from the upper piston space 22*b* into the tank 200, when an excess pressure of e.g. about 3 bar is reached. During the above-described lowering operation of the spring strut, hydraulic fluid then present in the upper piston space 22*b*, which is expelled due to the pressure increase in the lower piston space 22*a*, can flow back into the reservoir 200 of the hydraulic system H.

Figure 6:
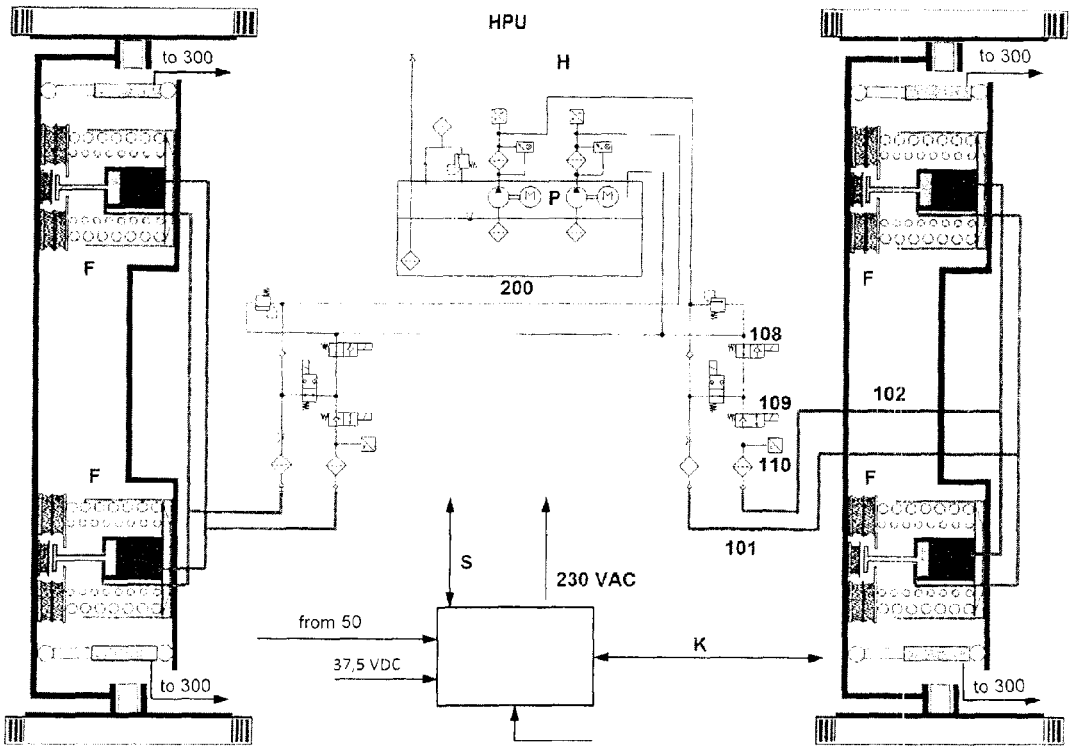
FIG. 6 shows a schematic view of again another embodiment of a spring system according to the invention.

FIG. 6 shows a schematic view of again another embodiment of a spring system according to the invention, wherein this embodiment in particular differs from the embodiment shown in FIG. 5 in that the pressure in the upper piston space 22*b* is actively raised above the level of the pressure in the lower piston space 22*a* and the spring strut F thus can hydraulically be lifted to driving level independent of the restoring force of the mechanical spring 30.

For this purpose, the pressure limiting valve 107 in the relief line 106 is replaced by a solenoid valve 108 with two switching positions, which is normally open and provides for an active extension of the cylinder. Furthermore, in the hydraulic line 102 of the upper piston space 22*b* on the piston side of the branching point 105 a further solenoid valve 109 with two switching positions is provided, which is normally closed. This is a fail-safe valve which effects that the upper piston space 22*b* also remains pressurized in the currentless condition. Furthermore, a hydropneumatic accumulator 110 was incorporated on the piston-space side of the solenoid valve 109.

The invention claimed is:

1. A spring system of a rail vehicle with a spring strut for arrangement between a bogie and a carriage body of the rail vehicle, the spring strut comprising:

a cylinder, a piston shiftably accommodated in the cylinder and including a piston head, defining lower and upper piston spaces below and above the piston head, and a piston rod, one of the piston and the cylinder being directly or indirectly connectable with the bogie and the other of the piston and the cylinder being directly or indirectly connectable with the carriage body, a spring arranged to cushion the carriage body with respect to the bogie, and an entraining element that adjoins the spring, wherein the spring system includes a hydraulic system connected with at least one of the piston spaces such that the at least one of the piston spaces can be charged with hydraulic medium, the piston spaces are arranged such that the spring is contracted by the piston when an excess pressure exists in the lower piston space with respect to the upper piston space, the spring surrounds the cylinder, the piston rod is arranged such that the piston rod only exerts a force on the entraining element when an excess pressure exists in the lower piston space with respect to the upper piston space, and the piston rod, when no excess pressure exists in the lower piston space with respect to the upper piston space, has a clearance with respect to the entraining element in at least one of a transverse direction relative to the piston and a direction of movement of the piston.

2. The spring system according to claim 1, wherein the piston and the cylinder form a unit having a first end and a second end, and only one of the first and second ends directly or indirectly is firmly connected with the spring.

3. The spring system according to claim 1, wherein at least one portion of the piston rod is designed flexible or articulated.

4. The spring system according to claim 3, wherein the at least one portion of the piston rod is formed tapered with respect to adjacent regions or is formed by a movable coupling rod, chain, or wire rope.

5. The spring system according to claim 2, wherein the unit is a first unit, and further comprising a further piston-cylinder unit arranged in series with the first unit for wheel wear compensation.

6. The spring system according to claim 1, wherein the lower piston space, when an excess pressure exists therein with respect to the upper piston space, is in a condition charged with hydraulic medium, and when no excess pressure exists in the lower piston space with respect to the upper piston space, is in a condition not charged with hydraulic medium.

7. The spring system according to claim 6, wherein only exactly one hydraulic line extends from the hydraulic system to the lower piston space.

8. The spring system according to claim 6, wherein the hydraulic system includes two 2/2-way valves or one 3/2-way valve for the lower piston space.

9. The spring system according to claim 6, wherein the hydraulic system is formed such that relief for the lower piston space is designed redundant.

10. The spring system according to claim 6, wherein the hydraulic system includes a tank, and, between the tank and the lower piston space, and between a pump and the lower piston space, normally open valves exclusively are provided to relieve the lower piston space to permit redundant relief without provision of additional valves.

11. The spring system according to claim 6, wherein the hydraulic system includes one actuation strand for each piston space, bogie axle, or carriage body.

12. The spring system according to claim 1, wherein, from the hydraulic system, at least one hydraulic line each extends to the lower piston space and to the upper piston space, and the at least one hydraulic line extending to the upper piston space branches off from the at least one hydraulic line extending to the lower piston space.

13. The spring system according to claim 12, wherein, in the at least one hydraulic line extending to the upper piston space, a normally open 2/2-way valve is arranged.

14. The spring system according to claim 12, wherein, from the hydraulic line extending to the upper piston space, a relief line branches off on a piston side of the 2/2-way valve.

15. The spring system according to claim 14, further comprising a pressure limiting valve arranged in the relief line that provides for a discharge of hydraulic fluid from the upper piston space when an excess pressure is reached.

16. The spring system according to claim 14, wherein, in the relief line, a normally open 2/2-way valve is arranged, and/or in the hydraulic line, of the upper piston space, a normally closed 2/2-way valve is arranged on a piston space side of a branching point.

17. The spring system according to claim 1, further comprising a height sensor arranged to emit a signal characteristic for the length of the spring strut.

18. The spring system according to claim 17, further comprising a control or regulating unit provided for height adjustment and connected with the height sensor and the hydraulic system such that a certain value of a height of the spring strut is adjustable.

19. A rail vehicle, with the spring system according to claim 1.

* * * * *